US009273878B2

(12) United States Patent
Kucera

(10) Patent No.: US 9,273,878 B2
(45) Date of Patent: Mar. 1, 2016

(54) DEVICE INTERFACE FOR A BUILDING APPLIANCE

(71) Applicant: Honeywell International Inc., Morristown, NJ (US)

(72) Inventor: David Kucera, Czech Republic (CZ)

(73) Assignee: Honeywell International Inc., Morris Plains, NJ (US)

( * ) Notice: Subject to any disclaimer, the term of this patent is extended or adjusted under 35 U.S.C. 154(b) by 345 days.

(21) Appl. No.: 13/900,182

(22) Filed: May 22, 2013

(65) Prior Publication Data

US 2014/0350732 A1 Nov. 27, 2014

(51) Int. Cl.
*G05B 11/01* (2006.01)
*G05B 15/00* (2006.01)
*F24F 11/00* (2006.01)

(52) U.S. Cl.
CPC ..... *F24F 11/0009* (2013.01); *F24F 11/006* (2013.01); *F24F 2011/0068* (2013.01)

(58) Field of Classification Search
CPC ..... H04L 12/2803; H04L 12/2823; H04L 12/2825; H04L 43/065; H04M 11/007
USPC ..... 700/17, 27, 83
See application file for complete search history.

(56) References Cited

U.S. PATENT DOCUMENTS 7,860,271 B2 12/2010 Liu
9,008,642 B2 * 4/2015 Caley et al. ..... 455/418
2006/0240867 A1 10/2006 Wang et al.
2009/0303176 A1 12/2009 Chen et al.
2010/0146445 A1 6/2010 Kraut
2010/0238194 A1 9/2010 Roach, Jr.
2010/0325554 A1 12/2010 Lee
2013/0185079 A1 * 7/2013 Park et al. ..... 704/275
2014/0006953 A1 * 1/2014 Kim ..... 715/727
2014/0009300 A1 * 1/2014 Ha et al. ..... 340/679
2014/0199981 A1 * 7/2014 Caley et al. ..... 455/418
2015/0081103 A1 * 3/2015 Song et al. ..... 700/275

FOREIGN PATENT DOCUMENTS

WO WO2012091384 * 7/2012 ..... H04L 12/26

OTHER PUBLICATIONS

Machine Translation, using WIPO website, of KR2011010098, also known by WO2012091384, by Hyun Sang Kim, printed from Internet on Jun. 18, 2015; 16 pages.*
https://projects.developer.nokia.com/electricityscanner/wiki, "Electricity Scanner," 4 pages, printed Feb. 8, 2013.
https://projects.developer.nokia.com/electricityscanner, "Electricity Scanner," 3 pages, printed Feb. 8, 2013.
http://www.windowsphone.com/en-usistore/app/electricity-usage/1f723e8a-4fd7-42af-9d . . . "Electricity Usage—Windows Phone Apps+Games Store (United States)," 2 pages, Dec. 18, 2012.

* cited by examiner

*Primary Examiner* — Ronald Hartman, Jr.
(74) *Attorney, Agent, or Firm* — Seager, Tufte & Wickhem LLP

(57) ABSTRACT

A smart phone or a tablet may execute an application program code to identify a diagnostic status associated with a time-coded signal emitted by a low-cost user interface of a building appliance such as a furnace or water heater and suggest a recommended action to the user. The signal emitted by the low-cost user interface may be audio or a visual signal.

17 Claims, 6 Drawing Sheets

DEVICE INTERFACE FOR A BUILDING APPLIANCE

TECHNICAL FIELD

The present disclosure relates generally to building appliances, and more particularly, to devices, systems, and methods for facilitating diagnostics of building appliances.

BACKGROUND

A number of different building appliances may be located within a building or structure. For a typical domestic dwelling, such building appliances may include, a heating, ventilation, and/or air conditioning (HVAC) system, a humidifier/dehumidifier, an air cleaner, a water heater, a pool heater, a water softener, a dishwasher, a security system, a garage door opener, a sprinkler system, an oven, a clothes washer and/or any other suitable building appliance. Often because of cost constraints, some building appliances incorporate a low-cost user interface which has limited capabilities. For example, a low-cost user interface may include a blinking LED light. In some cases, the LED may emit a coded signal indicative of a diagnostic status of the building appliance. To help with maintenance and/or repair of the building appliance, the coded signal may be read and manually decoded by a user in order to derive the diagnostic status of the building appliance.

SUMMARY

The present disclosure relates generally to building appliances, and more particularly to devices, systems, and methods for facilitating diagnostics of building appliances. The present disclosure may provide a more reliable system for conveying information from a building appliance to a user, for conveying more information from a building appliance to a user, and/or for providing external information to the user based on the information conveyed from a building appliance to a user. These are just some examples.

In one illustrative embodiment, a portable device for diagnosing an HVAC component having a user interface that emits a human perceptible time-coded signal includes: a user interface having a display; one or more sensors for sensing the human perceptible time-coded signal of the HVAC component and for providing a corresponding time-coded input signal; a memory storing a database that identifies one or more patterns, wherein each pattern is associated with diagnostic information for an HVAC component; and a controller coupled to the one or more sensors, the user interface and the memory. In some instances, the controller may be configured to perform a pattern recognition on the time-coded input signal, and based on the pattern recognition, identify a corresponding one of the one or more patterns stored in the database. Based on the identified one of the one or more patterns, the controller may display at least selected diagnostic information that is associated with the identified one of the one or more patterns on the display of the portable device.

In some instances, the controller may be configured to send a corresponding time-coded input signal to a server or the like via a wireless input/output port, and to receive diagnostic information from the server that is associated with the corresponding time-coded input signal. The controller may be configured to display at least selected diagnostic information that is received from the server on the display of the portable device.

In another illustrative embodiment, a system for determining a diagnostic code based, at least in part, on a signal emitted by a combustion device, includes a remote device and a server. The remote device may include an input/output port for wirelessly sending and/or receiving data over a network, a user interface including a display, a memory, and a controller coupled to the input/output port, the user interface, and the memory. The remote device may be configured to receive a signal emitted by a combustion device and to transmit a first data package including the received signal via the input/output port. The server may include an input/output port for sending and/or receiving data over a network, a memory storing a database including one or more patterns each associated with one or more diagnostic codes for a combustion device, and a controller coupled to the input/output port and the memory. The controller may be configured to receive the first data package transmitted by the remote device. Upon receiving the signal from the remote device, the controller may perform a pattern recognition or the like and classify the signal received from the combustion device based, at least in part, on the one or more patterns stored in the database. The controller may also associate the signal with a particular diagnostic code.

In yet another illustrative embodiment, a method of classifying a signal emitted by a combustion or other device can include the steps of: receiving a first data package over a network from a remote device, the first data package including a signal indicative of a diagnostic code associated with a combustion device; performing a pattern recognition on the signal received from the remote device based, at least in part, on the one or more patterns stored in a database, each pattern associated with a different diagnostic code for the combustion device; associating the signal with a particular diagnostic code; and transmitting a second data package over the network, where the second data package includes a command that causes the remote device to display information indicative of the diagnostic code associated with the signal classification.

The preceding summary is provided to facilitate an understanding of some of the innovative features unique to the present disclosure and is not intended to be a full description. A full appreciation of the disclosure can be gained by taking the entire specification, claims, drawings, and abstract as a whole.

BRIEF DESCRIPTION OF THE DRAWINGS

The disclosure may be more completely understood in consideration of the following description of various illustrative embodiments in connection with the accompanying drawings, in which.

Figure 1:
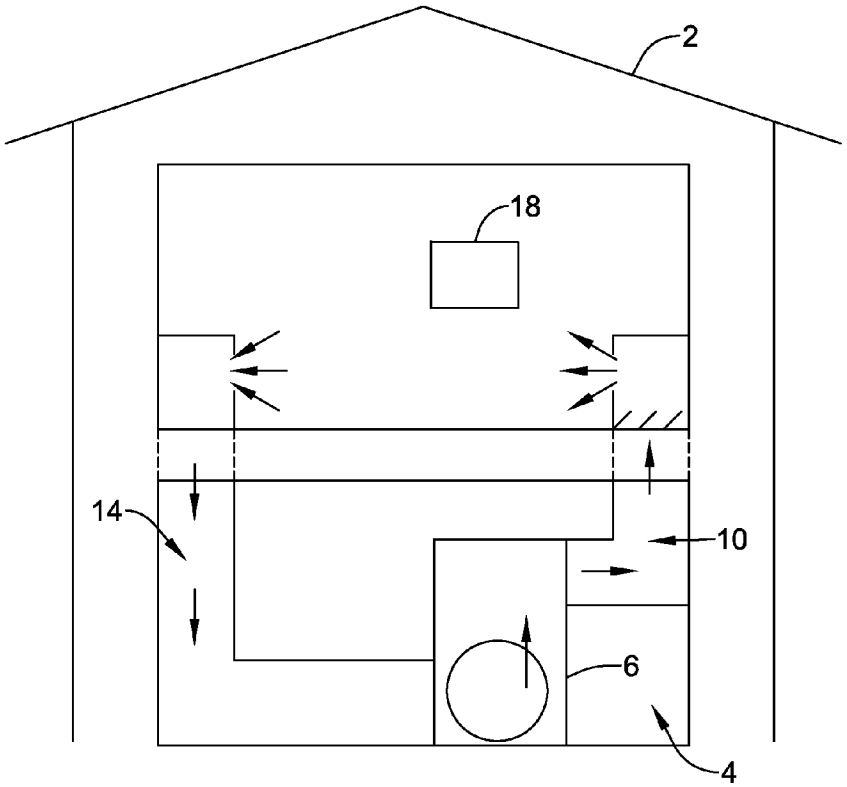
FIG. 1 is a schematic view of an illustrative HVAC system servicing a building or structure.

While the disclosure is amenable to various modifications and alternative forms, specifics thereof have been shown by way of example in the drawings and will be described in detail. It should be understood, however, that the intention is not to limit aspects of the disclosure to the particular illustrative embodiments described. On the contrary, the intention is to cover all modifications, equivalents, and alternatives falling within the spirit and scope of the disclosure.

DESCRIPTION

The following description should be read with reference to the drawings wherein like reference numerals indicate like elements throughout the several views. The description and drawings show several embodiments which are meant to be illustrative in nature.

For the purposes of providing an illustrative example, the various embodiments of the present disclosure are described in the context of an HVAC system. However, it is generally understood that many of the embodiments described herein may be utilized in connection with other building appliances and are not limited to use with an HVAC system. Exemplary building appliances with which the various embodiments of the present disclosure may be utilized include, but are not limited, to a humidifier/dehumidifier, an air cleaner, a water heater, a pool heater, a water softener, a dishwasher, a security system, a garage door opener, a sprinkler system, an oven, a clothes washer and/or any other suitable building appliance.

FIG. 1 is a schematic view of a building 2 having a heating, ventilation, and air conditioning (HVAC) system 4. While FIG. 1 shows a typical forced air type HVAC system, other types of HVAC systems are contemplated including, but not limited to, boiler systems, radiant heating systems, electric heating systems, cooling systems, heat pump systems, and/or any other suitable type of HVAC system, as desired. The illustrative HVAC system 4 of FIG. 1 includes one or more building appliance 6 (e.g. furnace), a system of ductwork and air vents including a supply air duct 10 and a return air duct 14, and one or more HVAC controllers 18. The one or more building appliances 6 may include, but are not limited to, a furnace, a heat pump, an electric heat pump, a geothermal heat pump, an electric heating unit, an air conditioning unit, a humidifier, a dehumidifier, an air exchanger, an air cleaner, a damper, a valve, and/or the like.

At least one of the building appliances 6 may include a simple, low-cost user interface 8 electrically coupled to the building appliance 6, and that is configured to emit a signal indicative of a diagnostic status or other information related to the component to which it is coupled. In some cases, each of the different building appliances 6, listed above, may include a simple, low-cost user interface 8 that is configured to emit a signal indicative of a diagnostic status or other information. The signal emitted by the low-cost user interface 8 may be a human perceptible audio and/or visual signal and in some cases, may be a human perceptible, time-coded audio or visual signal. In one example, the low-cost user interface 8 may include a light-emitting diode (LED) that is configured to emit one or more pulses of light. The one or more pulses of light may form at least part of a LED code. The LED code may be a human perceptible, time-coded, visual signal. In other cases, the low-cost user interface 8 may include a sound transmitted that is configured to emit one or more audible beeps or other sounds. The one or more audible beeps may form at least part of a beep code. In some cases, the beep code may be considered a human perceptible time-coded audible signal. In some cases, the sound transmitted by the low-cost user interface 8 may be one of a plurality of well-known songs, where each song can be considered a time-coded audible signal. In some cases, different numbers and/or patterns of light pulses and/or audible signals may each correspond to a different diagnostic status of the component to which the low-cost user interface 8 is coupled. In some cases, the signal may be a combined audio/visual signal.

Figure 2:
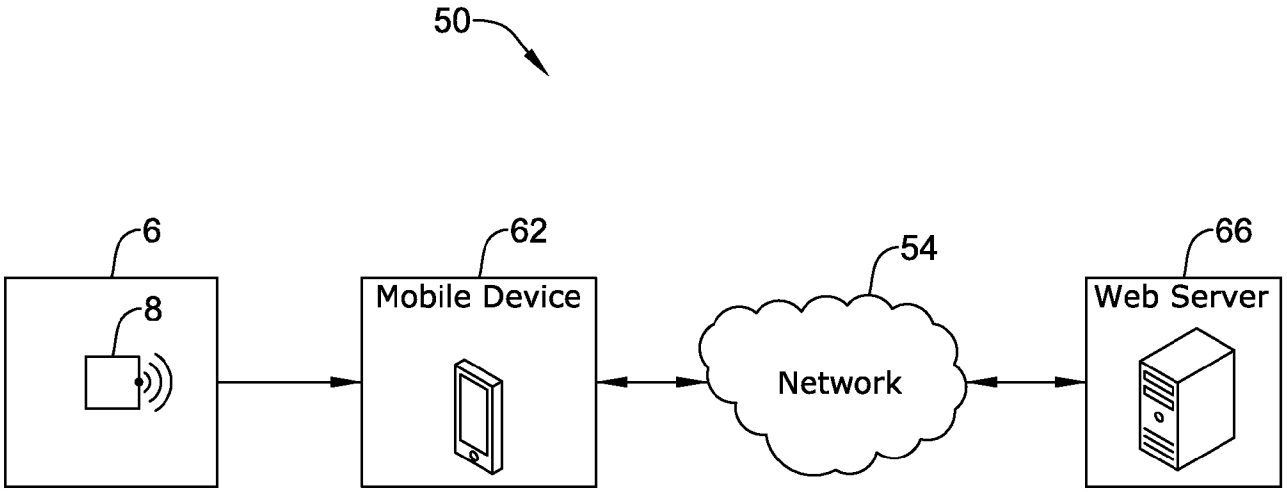
FIG. 2 is a schematic view of a system that facilitates interaction between a portable device and low-cost user interface of a building appliance.

FIG. 2 is a schematic view of a system 50 that facilitates interaction between a user's portable device 62 and low-cost user interface 8 of a building appliance 6. The system 50 may facilitate interaction between a user's portable device 62 and any number of exemplary building appliances including, but not limited to a heating, ventilation, and/or air conditioning (HVAC) system, a humidifier/dehumidifier, an air cleaner, a water heater, a pool heater, a water softener, a dishwasher, a security system, a garage door opener, a sprinkler system, an oven, a clothes washer and/or any other suitable building appliance. In the illustrative example shown in FIG. 2, the building appliance 6 may be a combustion device such as, for example, a furnace or water heater.

The building appliance 6 may include a low-cost user interface 8. The low-cost user interface 8 may be configured to emit a signal indicative of a diagnostic status or other information related to the operation of the building appliance 6. In this case, the low-cost user interface 8 may be configured to emit a signal indicative of the diagnostic status of a building appliance 6. The signal emitted by the low-cost user interface 8 may be an audio or visual signal. In some cases, the signal may be a combined visual/audio signal. In some cases, the signal may be a human perceptible time-coded signal. For example, different numbers and/or patterns of light pulses and/or audible beeps may each correspond to a different diagnostic status of the building appliance 6. In some cases, the low-cost user interface 8 may transmit one of a plurality of well-known songs (e.g. Alphabet Song, A Hunting We Will Go, Do Re Mi, Three Blind Mice, etc.), where each song can be considered a time-coded audible signal that corresponds to a different diagnostic status of the building appliance 6.

In some cases, the low-cost user interface 8 may include a light-emitting diode (LED) that is configured to emit one or more pulses of light. The one or more pulses of light may form at least part of a LED code, which may include a pattern of one or more emitted light pulses, and which, in some cases, may be a human-perceptible time-coded LED code. In some cases, the pattern may be too rapid or complex to be readily human-perceptible. In some cases, the pattern may be a simple pattern based on the number of emitted light pulses. For example, in some cases, the low-cost user interface 8 may be configured to emit a string of light pulses at a rate of one light pulse per second. Each different number of light pulses (e.g. 3 light pulses) in a string of light pulses emitted by the low-cost user interface may define a different pattern indicative of a diagnostic status of the building appliance 6. In other cases, the pattern of emitted light pulses may be more complex. The pattern of emitted light pulses may include one or more emitted light pulses followed by a short pause followed by one or more additional emitted light pulses. In one example, the low-cost user interface 8 may emit three light pulses (e.g. one light pulse per second) followed by, for example, a two to five second pause followed by another two light pulses (e.g. one light pulse per second). Any combination of a number of emitted light pulses and pauses may be used. Patterns including longer sequences of emitted pulses and pauses may also be utilized. The duration of the light pulses may also determine a pattern. In another example, the pattern of light pulses may include a plurality of light pulses that alternate the brightness of the emitted light from one emitted light pulse to the next light pulse such that the emitted light pulses appear to pulsate. In still other examples, the pattern of emitted light pulses may include one or more light pulses of a first color followed by one or more light pulses of a second color. For example, the user interface 8 may emit two red light pulses followed by a green light pulse. Any combination of the number of emitted light pulses, intensity, duration and color may be utilized, as desired. These are just some examples.

In other cases, the low-cost user interface 8 may include a sound transmitter that is configured to emit one or more audible beeps, tones, melodies and/or other audible sounds. In some cases, one or more audible beeps may form at least part of a beep code, which may include a pattern of one or more emitted audible beeps, and which, in some cases, may be a human perceptible time-coded beep code. In some cases, the audible beeps may be too rapid or complex to be readily human-perceptible. In some cases, the pattern may be a simple pattern based on the number of emitted audible beeps. For example, in some cases, the low-cost user interface 8 may be configured to emit a string of audible beeps at a rate of one beep per second. Each different number of audible beeps (e.g. 3 audible beeps) in a string of audible beeps emitted by the low-cost user interface may define a different pattern indicative of a diagnostic status of the building appliance 6. In other cases, the pattern of audible beeps may be more complex. The pattern of audible beeps may include one or more audible beeps followed by a short pause followed by one or more additional audible beeps. In one example, the low-cost user interface 8 may emit three audible beeps (e.g. one audible beep per second) followed by, for example, a two to five second pause followed by another two audible beeps (e.g. one audible beeps per second). Any combination of a number of emitted audible beeps and pauses may be used. Patterns including longer sequences of audible beeps and pauses may also be utilized. The duration of the audible beeps may also determine a pattern. In another example, the pattern of audible beeps may include a plurality of audible beeps that change the intensity or loudness from one emitted audible beep to the next audible beep. In still other examples, the pattern of audible beeps may include one or more audible beeps of a first frequency (i.e. note on a musical scale) followed by one or more audible beeps at a second frequency. For example, the user interface 8 may emit two c-note audible beeps followed by a g-note audible beep. Any combination of the number of audible beeps, intensity, duration and frequency may be utilized, as desired. These are just some examples.

The user's portable device 62 may be configured to receive and, in some cases, interpret the signal emitted by the low-cost user interface 8. The user's portable device 62 may be, for example, a hand-held portable device such as a smart phone, a tablet computer and/or any other suitable portable device, as desired. In some cases, the user's portable device 62 may be a dedicated portable device 62 configured to perform diagnostics on selected building appliances such as, for example, a furnace. The portable device 62 may include a video camera and/or a microphone configured to receive and record the signal emitted by the low-cost user interface 8. The signal may be stored locally, at least temporarily, in the memory of the portable device 62. Using a device to receive and interpret the signal emitted by the low-cost user interface 8 rather than relying on human perception may increase the accuracy of the interpretation of the signal and reduce human error. Increasing the accuracy of interpreting the signal, sometimes indicative of the diagnostic status of the building appliance 6, may also decrease the amount of time that may be required to trouble-shoot the building appliance 6, which may reduce the amount of time that a technician or installer may need to spend on a service call. In some cases, using a portable device to receive and interpret the signal emitted by the low-cost user interface 8 may allow more information to be conveyed from the building appliance 6. Additionally, it may reduce user frustration.

In some cases, the portable device 62 may be configured to execute a program code that is stored in the memory of the portable device 62 for identifying the diagnostic status and/or other information corresponding to the signal emitted by the low-cost user interface 8. The program code may cause the portable device 62 to perform pattern recognition on the signal and identify the diagnostic status and/or other information based on the recognized pattern of, for example, the emitted light pulses or audible beeps or tones. In some cases, the portable device may identify the diagnostic status and/or other information based on the signal pattern using a look-up table or a database stored in the memory of the portable device 62. In some cases, the look-up table or database may contain a number of different signal pattern/diagnostic status pairs that may be used to associate an identified signal pattern with a particular diagnostic status related to the building appliance 6. Upon identifying the diagnostic status of the building appliance 6 based on the emitted signal, the portable device 62 may be programmed to display the diagnostic status of the building appliance 6 to the user via a display of the user's portable device 62. The user may then use this information to determine a suitable action. In some cases, context sensitive information, which pertains to the identified diagnostic status, may be automatically retrieved and presented to the user via the display of the user's portable device.

In some instances, the portable device 62 may be configured to transmit or upload the signal that it received from the low-cost user interface 8 to an external web server 66 via one or more networks 54. An exemplary web server 66 is Honeywell's TOTAL CONNECT™ web server. The portable device 62 may be configured to communicate wirelessly over one or more networks 54 and/or one or more wired networks with the web server 66. The wireless network, when used, may include any number of wireless communications protocols including, but not limited to, cellular communication, ZigBee, REDLINK™, Bluetooth, WiFi, IrDA, dedicated short range communication (DSRC), EnOcean, and/or any other suitable common or proprietary wireless protocol, as desired. In some cases, the network 54 may include a cellular communications network such as a 3G or 4G network, and the portable device 62 may be configured to communicate over the network 54 using a cellular communications protocol. In other cases, the portable device 62 may be configured to communicate with the external web server 66 by first connecting to a wireless local area network (WAN) via a gateway that is then used to access the external web server 66 via a wide area network such as, for example, the Internet. In this example, the portable device 62 may utilize a wireless communication protocol such as for example, WiFi or ZigBee to connect to the wireless local area network. For example, the wireless local area network may be the homeowner's secure wireless local area network located within the home within which the building appliance 6 is also located.

The external web server 66 may be programmed to execute a program code for identifying the pattern and/or the diagnostic status to which the signal emitted by the low-cost user interface 8 corresponds. The program code may cause the web server 66 to perform a pattern recognition on the signal delivered from the portable device 62 and identify the diagnostic status of the building appliance 6 based on the recognized pattern on the emitted light pulses or audible beeps or tones. In some cases, the web server 66 may identify the diagnostic status based on the signal pattern using a look-up table or a database stored on the server 66. The look-up table or database may contain a number of different signal pattern/diagnostic status pairs that may be used to associate the signal pattern with selected diagnostic information related to the building appliance 6. After identifying the diagnostic status and/or other information to which the signal emitted by the low-cost user interface 8 corresponds, the web server 66 may be configured to transmit the information containing the diagnostic status to the user's portable device 62 over the network 54. The user's portable wireless device 62 may then display the information containing the diagnostic status to the user via the display of the user's portable wireless device 62. The user may use this information to determine a suitable action. In some cases, the user's portable device 62 may display a recommended action such as, for example, in the form of written, audio, and/or visual instructions.

In some instances, the portable device 62 may receive information regarding the manufacturer and/or model of the building appliance 6. This information may be encoded in the coded signal emitted by the low-cost user interface 8, entered into the portable device 62 via the user interface of the portable device 62 using text and/or audio input, provided by the web server 66, or in any other manner. This information may be used in identifying the diagnostic status of the building appliance 6 based on the recognized pattern on the emitted light pulses or audible beeps or tones.

Figure 3:
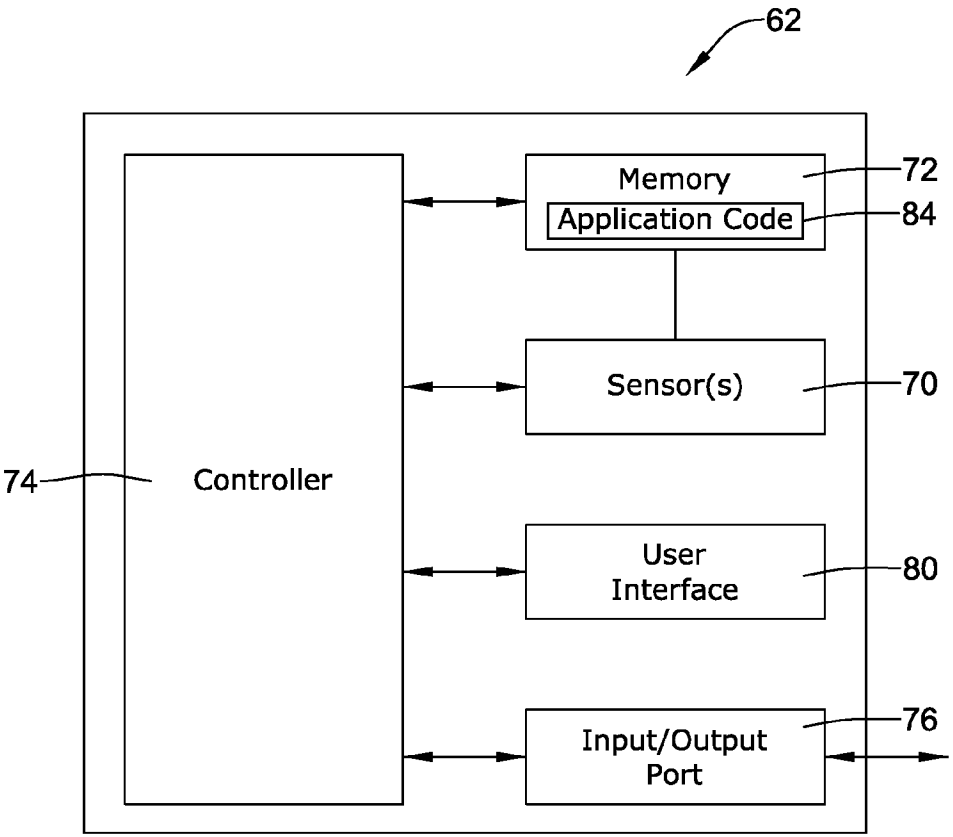
FIG. 3 is a schematic block diagram of an illustrative portable device that may be used with the system shown in FIG. 2.

FIG. 3 is a schematic view of an exemplary portable device 62 that may be configured to receive and interpret the signal emitted by the low-cost user interface 8 as described above with reference to FIG. 2. As discussed herein, the portable device 62 may be a hand-held portable device, and may be any one of a smart phone, a tablet computer and/or any other suitable portable device. In some cases, the portable device 62 may be a dedicated portable device 62 configured to perform diagnostics on a selected building appliance such as, for example, a furnace.

In some instances, the portable device 62 may include one or more sensors 70 for sensing a time-coded signal emitted by the low-cost user interface 8 as discussed in greater detail with reference to FIG. 2. In some cases, the one or more sensors 70 may include a microphone and/or a video camera for capturing and recording the time-coded signal emitted by the low-cost user interface 8. The one or more sensors 70 may be configured to transfer the recorded signal to a memory 72 where it may be at least temporarily stored. As shown in FIG. 3, the portable device 62 may include at least one input/output port 76 for communicating over one or more networks (e.g. a wireless local area network (wLAN), cellular network, and/or a wide area network (WAN) such as, for example, the Internet). The input/output port 76 may include at least one wireless transceiver for wirelessly sending and/or receiving signals over the one or more networks. Additionally, the illustrative portable device 62 may include a processor (e.g. microprocessor, microcontroller, etc.) 74 coupled to and in communication with the one or more sensors 70, the memory 72, an input/output port 76, and a user interface 80. In many cases, the user interface 80 may include a graphical user interface 80 including a touch screen liquid crystal display (LCD), but this is not required.

The memory 72 may be any suitable type of storage device including, but not limited to, RAM, ROM, EPROM, flash memory, a hard drive, user-removable memory, and/or the like. In some cases, the processor 74 may store information within the memory 72, and may subsequently retrieve the stored information from the memory 72.

The processor 74 may be configured to retrieve and execute application program code 84 stored in the memory 72 of the portable device 62. It will be generally recognized that multiple application codes for executing different functions may be stored in the memory 72 of the portable device 62. According to various embodiments, the memory 72 may include an application program code 84 stored thereon for performing a pattern recognition on a time-coded signal emitted by a low-cost user interface 8 associated with a building appliance 6 such as, for example, a furnace or water heater. The application program code 84 may be suitable for use with any current or future smart phone and/or tablet operating system including, for example, but not limited to Apple Inc.'s iOS, Google Inc.'s Android operating systems (e.g. Jelly Bean or Ice Cream Sandwich), and/or Microsoft Inc.'s Windows operating systems (e.g. Windows). The application program code 84 may also be executable by, for example, Amazon.com Inc.'s KINDLE or KINDLE FIRE. The application program code 84 may be available for download from a variety of online sources including Apple Inc.'s ITUNES®, Google Inc.'s Google Play, or Amazon.com (www.amazon.com). In some cases, the application program code 84 may be available for download from a web server or service associated with a building appliance manufacturer such as, for example, Honeywell's TOTAL CONNECT™ web server. These are just some examples In some instances, the application program code 84 may cause the processor 74 to perform pattern recognition on the signal emitted by the low-cost user interface 8 and identify the diagnostic status based on the recognized pattern of the emitted light pulses or audible beeps. In some cases, the application program code 84 may include, or have access to, at least part of a database or a look-up table that identifies one or more patterns, with each pattern associated with diagnostic and/or other information for a building appliance 6. In some cases, the database or look-up table may be downloaded from an external web server (e.g. web server 66) via the input/output port 76 where it may then be stored in the memory 72. The database or look-up table may contain a number of different signal pattern/diagnostic status pairs that may be utilized by the processor 74 to associate the identified signal pattern with a particular diagnostic status related to the building appliance 6. In some cases, the database may be a database specific to the particular building appliance 6 that is being installed or serviced by a technician. For example, the database associated with the application program code 84 may include diagnostic information specific to the building appliance 6, shown in FIG. 1, as well as various components (e.g. valves, sensors, dampers, blower fan, etc.) that may be associated with the building appliance 6. In other cases, it may be a larger database that includes a plurality of patterns, each pattern associated with diagnostic information for multiple building appliances, sometimes with different manufacturers. It will be generally understood that the size of the database is dependent upon the capacity of the memory 72 of the portable device 62. Upon identifying the diagnostic status of the building appliance 6 based on the emitted signal, the application program code 84 may cause the processor 74 to display the diagnostic status of the building appliance 6 to the user via the display of the user interface 80. The user may then use this information to determine a suitable action. In some cases, the application program code 84 may cause the processor 74 to display a recommended action to the user via the user interface 80 such as, for example, in the form of written, audio, and/or visual instructions.

In another example, as will be discussed in greater detail below, the application program code 84 may cause the processor 74 to transmit a data package including the signal that it received from the low-cost user interface 8 to an external web server 66 over one or more networks 54 via the input/ output port 76. The data package transmitted by the processor 74 may also include information about the building appliance 6 such as, for example, manufacturer name and model number and/or part number of the building appliance 6. To get the model number, etc., the portable device 62 may be configured to scan and/or read a bar code or a quick-response (QR) code that is mounted to the building appliance 6 using a camera functionality of the portable device 62. An illustrative device and method for reading a QR Code are shown and described in U.S. application Ser. No. 13/603,306 entitled SYSTEM AND APPROACH TO CONVEY DATA WITH A HAND-HELD DEVICE VIA A MULTI-DIMENSIONAL CODE, filed on Sep. 4, 2012, which is incorporated herein by reference in its entirety for all purposes.

When so provided, the portable device 62 may be configured to include the information from the QR code in a data package transmitted to the web server 66. The QR code may include information about the building appliance 6 such as, for example, the manufacturer name and model number and/or part number. This information may be used by the web server 66 to select an appropriate database or look-up table for identifying the signal pattern.

The web server 66 may be programmed to perform a pattern recognition on the signal and classify the diagnostic status of the building appliance 6 based on the recognized pattern on the emitted light pulses or audible beeps. The web server 66 may transmit a return data package to the portable device 62 over the network 54 including a command that causes the portable device 62 to display information indicative of the diagnostic status associated with the emitted signal on the display of the user interface 80 of the portable device 62. In some cases, the return data package may include a command that causes the user's portable device 62 to display a recommended action to the user via the user interface 80 such as, for example, in the form of written, audio, and/or visual instructions. The user may then use this information to determine a suitable action.

Figure 4:
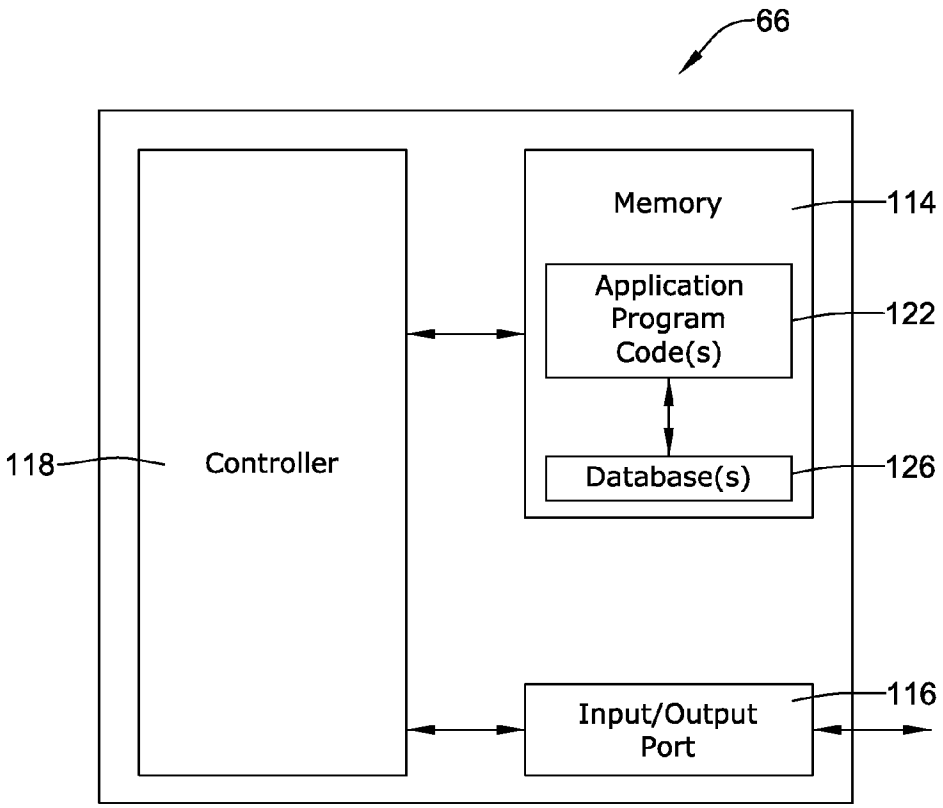
FIG. 4 is a schematic block diagram of an illustrative web server that may be used with the system shown in FIG. 2.

FIG. 4 is a schematic view of an external web server 66 that may be configured to interact with a portable device 62 over a network such as for example, a cellular network or the Internet. The portable device 62 may be, for example, any one of the portable devices 62 described herein. In some cases, the external web server 66 may host an external web service that is adapted to serve up one or more web pages via the network 54 and that may be viewable on the display of a portable device 62.

As shown in FIG. 4, the external web server 66 can include at least one input/output port 116 for sending and/or receiving data over the network 54 to and from a portable device 62. It will be generally understood that the external web server 66 is capable of interacting with multiple devices via the input/output port. The external web server 66 can also include a memory device 114 and a controller 118 coupled to the input/output port 116 and the memory device 114.

The memory device 114 of the external web server 66 may include at least one database 126 containing a number of different signal pattern/diagnostic status pairs that may be utilized by the controller 118 to associate the signal pattern with a diagnostic status related to a particular building appliance 6. In some cases, the database 126 may be a database specific to the particular building appliance that is being installed or serviced by a technician. In other cases, the database 126 may be a larger database that includes a plurality of patterns, each pattern associated with diagnostic information for multiple building appliances, sometimes across different manufacturers. In still other cases, the memory device 114 may include multiple databases 126, each database 126 containing a number of different signal pattern/diagnostic status pairs related to a number of different building appliances.

In some cases, the controller 118 may be configured to implement an application program code 122 for performing pattern recognition on a signal emitted by a low-cost user interface 8 of a building appliance 6. The signal may be included in a data package transmitted by a portable device 62 over the network 54 and received by the external web server 66 via the input/output port 116. The data package received by the controller 118 via the input/output port 116 may also include information about the building appliance 6, such as the manufacturer name and model number and/or part number. This information may be used by the controller 118 to select an appropriate database or look-up table 126 associated with the particular building appliance 6 for identifying the signal pattern.

The application program code 122 may cause the controller 118 to use the information stored in the database 126 to identify the diagnostic status based on the recognized pattern of the emitted light pulses or audible beeps. Upon identifying the diagnostic status of the building appliance 6 based on the emitted signal, the application program code 122 may cause the controller 118 to transmit a return data package to the portable device 62 over the network 54 via the input/output port 116 including information regarding the diagnostic status of the building appliance 6. Additionally, the data package transmitted by the controller 118 to the portable device 62 may include a command that causes the portable device 62 to display information indicative of the diagnostic status of the building appliance 6 associated with the emitted signal on the display of the user interface 80 of the portable device 62 such that it may be viewed by a user. Additional support information associated with the diagnostic status may be delivered to the portable device 62 and displayed on the user interface 80. This additional support information may be stored in the database 126 and may be indexed to the identified diagnostic status. The user may then use this information to determine a suitable action.

In some cases, the additional support information may describe some suitable action. For example, in some cases, the additional support information may include a video showing the user what actions to take, step-by-step. When the diagnostic code or other information indicates a service call is warranted, contact information for a service contractor may be displayed on the display of the portable device 62. In some case, the service providers would be charged a fee to be displayed in this fashion. Further, the portable device 62 and/or external web-server may send additional diagnostic information to the service provider before the service provide arrives on scene. This may help the service provider determine the proper personnel and/or parts to send, thereby reducing the cost of the service calls. In some case, if the diagnostic code indicates a particular part needs to be replaced, the portable device 62 may display a button or link on the display that may allow the user of the portable device 62 to order the part immediately.

Figure 5:
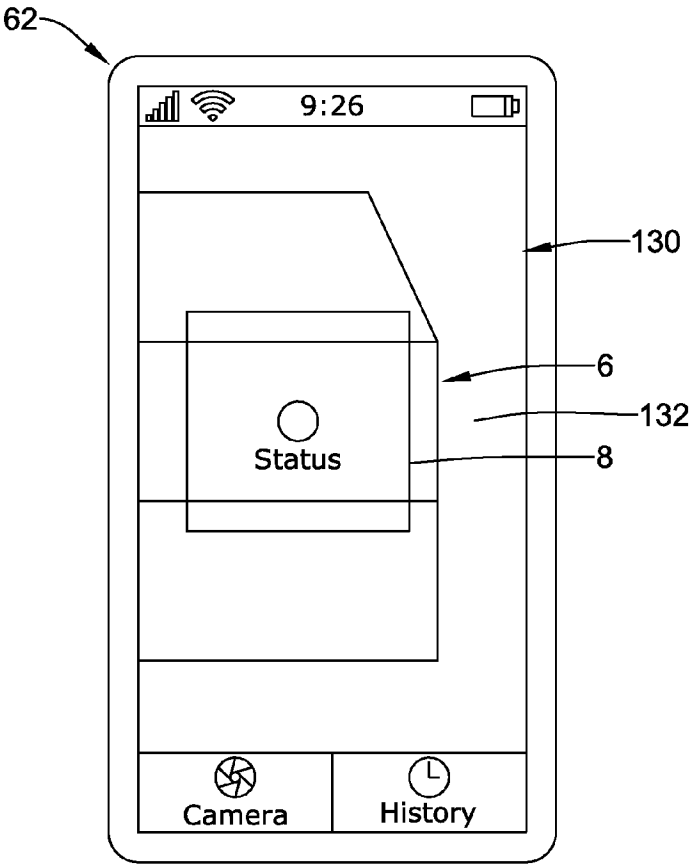
FIGS. 5 and 6 are exemplary screens that may be displayed on an illustrative portable device.

FIG. 5 shows an exemplary still frame 132 of a video that may be displayed on a display 130 of a user interface 80 of a portable device 62 after the signal emitted by the low-cost user interface 8 of a building appliance 6 is captured and/or recorded by the portable device 62. In this example, a video camera was used to capture and record a visual signal including a series of flashing lights emitted by the low-cost user interface 8 of a building appliance 6. The low-cost user interface 8 is depicted in the first still frame 132.

Figure 6:
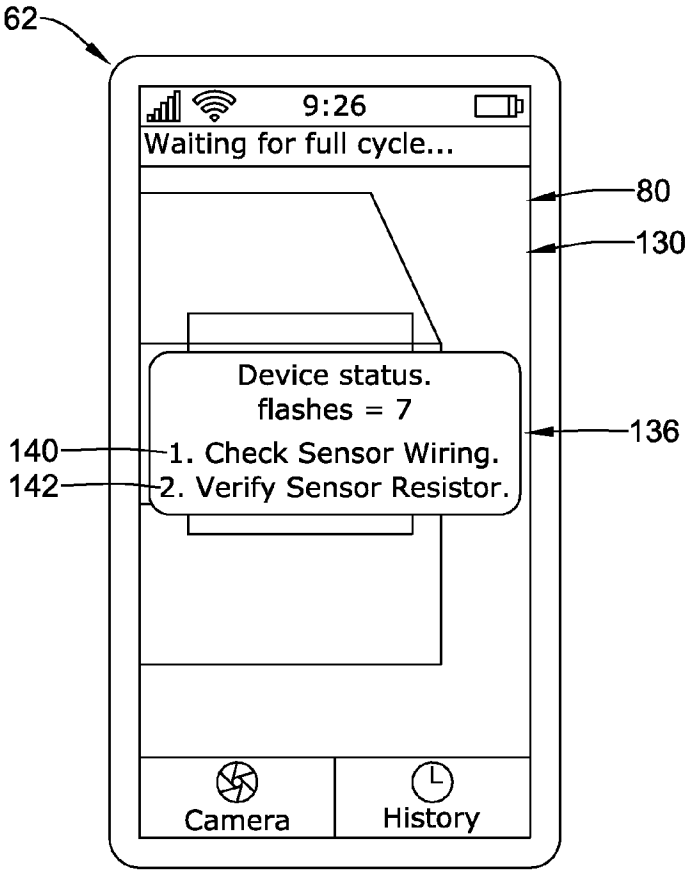

FIG. 6 shows an exemplary screen 136 that may be displayed on the display 130 of the user interface 80 of the portable device 62 after a pattern recognition on the emitted signal captured by the video camera has been performed. As discussed herein, the pattern recognition may be performed by the portable device 62 or another device such as, for example, an external web server 66. As shown in FIG. 6, the diagnostic status associated with the pattern of 7 flashes emitted by low-cost user interface 8 has been classified as a "Temperature Sensor Fault." Additionally, as shown in FIG. 6, screen 136 includes two recommended actions to the user. For example, screen 136 includes a first user recommendation 140 which instructs the user to check the sensor wiring. Additionally, screen 136 includes a second user recommendation 142 which instructs the user to verify the sensor resistance. It will be generally understood that other device statuses and/or other user recommendations may be displayed.

Having thus described several illustrative embodiments of the present disclosure, those of skill in the art will readily appreciate that yet other embodiments may be made and used within the scope of the claims hereto attached. Numerous advantages of the disclosure covered by this document have been set forth in the foregoing description. It will be understood, however, that this disclosure is, in many respect, only illustrative. Changes may be made in details, particularly in matters of shape, size, and arrangement of parts without exceeding the scope of the disclosure. The disclosure's scope is, of course, defined in the language in which the appended claims are expressed

What is claimed is:

1. A portable handheld device for diagnosing an HVAC component, wherein the HVAC component includes a user interface that emits a series of light pulses, the device comprising:

a user interface including a display;

one or more sensors including a camera for sensing the series of light pulses of the HVAC component, and for providing a video input signal of the series of light pulses;

a memory storing a database that identifies one or more patterns, wherein each pattern is associated with diagnostic information for an HVAC component; and a controller coupled to the one or more sensors, the user interface and the memory, the controller configured to perform a pattern recognition on the series of light pulses in the video input signal, and based on the pattern recognition, identify a corresponding one of the one or more patterns stored in the database, and based on the identified one of the one or more patterns, display at least selected diagnostic information that is associated with the identified one of the one or more patterns on the display of the device.

2. The portable handheld device of claim 1, wherein the one or more sensors further includes a microphone.

3. The portable handheld device of claim 1, further comprising:

an input/output port for wirelessly sending and/or receiving data over a network, wherein the database is provided to the memory via the input/output port.

4. The portable handheld device of claim 3, wherein the database is updated via the input/output port.

5. A portable handheld device for diagnosing an HVAC component, wherein the HVAC component includes a user interface that emits a series of light pulses, and wherein a server located on a network stores a database that identifies one or more patterns, with each pattern associated with diagnostic information for an HVAC component, the device comprising:

a user interface including a display;

one or more sensors including a camera for sensing the series of light pulses of the HVAC component, and for providing a video input signal of the series of light pulses;

a wireless input/output port for communicating with the server over a network; and a controller coupled to the one or more sensors, the user interface and the wireless input/output port, the controller configured to send the video input signal of the series of light pulses to the server via the wireless input/output port, and to receive diagnostic information from the server that is associated with the series of light pulses, the controller further configured to display at least selected diagnostic information that is received from the server on the display of the device.

6. The portable handheld device of claim 5, wherein the one or more sensors further includes a microphone.

7. A portable handheld device for diagnosing an HVAC component, wherein the HVAC component includes a user interface that emits a series of light pulses, and wherein a server located on a network stores a database that identifies a number of codes, with each code having associated diagnostic information for an HVAC component, the device comprising:

a user interface including a display;

one or more sensors including a camera for sensing the series of light pulses of the HVAC component, and for providing a video input signal of the series of light pulses;

a wireless input/output port for communicating with the server over a network; and a controller coupled to the one or more sensors, the user interface and the wireless input/output port, the controller configured to perform a pattern recognition on the series of light pulses in the video input signal to identify a corresponding code, and to send the identified code to the server via the wireless input/output port, and to receive diagnostic information from the server that is associated with the identified code, the controller further configured to display at least selected diagnostic information that is received from the server on the display of the device.

8. The portable handheld device of claim 7, wherein the one or more sensors further includes a microphone.

9. A system for determining a diagnostic code based, at least in part, on a series of light pulses emitted by a combustion device, the system comprising:

a remote device comprising an input/output port for wirelessly sending and/or receiving data over a network, a user interface including a display, a memory, and a controller coupled to the input/output port, the user interface, and the memory, the remote device configured to optically sense the series of light pulses emitted by the combustion device and to transmit a first data package that includes a representation of the series of light pulses via the input/output port; and a server including an input/output port for sending and/or receiving data over a network, a memory comprising a database including one or more patterns each associated with one or more diagnostic codes for a combustion device, and a controller coupled to the input/output port and the memory, the controller configured to receive the first data package transmitted by the remote device, whereupon receiving the first data package, the controller is programmed to perform a pattern recognition of the series of light pulses represented in the first data package and classify the series of light pulses based, at least in part, on the one or more patterns stored in the database and to associate the series of light pulses-signal with a particular diagnostic code.

10. The system according to claim 9, wherein the controller of the server is further programmed to transmit a second data package to the remote device via the input/output port of the server over the network, the second data package including a command that causes the remote device to display information indicative of the diagnostic code associated with the series of light pulses on the display of the user interface.

11. The system according to claim 9, further comprising a combustion device.

12. The system according to claim 9, wherein the remote device is any one of a smart phone, a laptop computer or a tablet computer.

13. The system according to claim 9, wherein the remote device further comprises a recording module for recording the series of light pulses emitted by the combustion device.

14. The system according to claim 13, wherein the recording module further includes a microphone.

15. The system according to claim 14, wherein the recording module comprises a video camera.

16. A computer readable medium having stored thereon in a non-transitory state software for use by a device connectable to a network, the software causing the device to execute a method comprising:

receiving a first data package over a network from a remote device, the first data package including a representation of a series of light pulses emitted by a combustion device;

performing a pattern recognition of the series of light pulses represented in the first data package based, at least in part, on one or more patterns stored in a database, each pattern associated with a different diagnostic code for the combustion device;

associating the series of light pulses represented in the first data package with a particular diagnostic code; and transmitting a second data package over the network, the second data package including a command that causes the remote device to display information indicative of the particular diagnostic code associated with the series of light pulses represented in the first data package.

17. A method of classifying a signal emitted by a combustion device comprising:

receiving a series of light pulses emitted by a combustion device at a first remote device, the series of light pulses indicative of a diagnostic code associated with the combustion device;

the remote device transmitting a first data package that includes a representation of the series of light pulses over a network;

receiving the first data package at a second remote device;

the second remote device performing a pattern recognition on the representation of the series of light pulses received from the first remote device based, at least in part, on the one or more patterns stored in a database, each pattern associated with a different diagnostic code for the combustion device;

the second remote device associating the representation of the series of light pulses signal with a particular diagnostic code; and the second remote device transmitting a second data package over the network to the first remote device, the second data package including a command that causes the first remote device to display information indicative of the diagnostic code associated with the representation of the series of light pulses.

* * * * *